US008522970B2

(12) United States Patent
Hsieh

(10) Patent No.: US 8,522,970 B2
(45) Date of Patent: Sep. 3, 2013

(54) PACKAGING/DISPLAYING DEVICE MADE FROM FOLDABLE BLANKS

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 198 days.

(21) Appl. No.: 13/100,985

(22) Filed: May 4, 2011

(65) Prior Publication Data

US 2012/0279899 A1 Nov. 8, 2012

(51) Int. Cl.
*B65D 5/50* (2006.01)

(52) U.S. Cl.
USPC ..... 206/320; 206/775; 206/779; 206/426

(58) Field of Classification Search
USPC ..... 206/320, 426, 486, 446, 742, 765, 206/277, 756, 326, 573, 779, 775
See application file for complete search history.

(56) References Cited

U.S. PATENT DOCUMENTS

| | | | | | |
|---|---|---|---|---|---|
| 3,002,722 | A * | 10/1961 | Cote | 248/174 |
| 3,252,566 | A * | 5/1966 | Hanson | 206/783 |
| 3,344,911 | A * | 10/1967 | Wolowicz et al. | 206/277 |
| 3,712,461 | A * | 1/1973 | Schillinger | 206/277 |
| 3,746,156 | A * | 7/1973 | Austin et al. | 206/277 |
| D458,842 | S * | 6/2002 | Humphrey | D9/432 |
| 2002/0125163 | A1 * | 9/2002 | Chou | 206/418 |
| 2012/0118768 | A1 * | 5/2012 | Boland | 206/320 |

* cited by examiner

*Primary Examiner* — David Fidei
(74) *Attorney, Agent, or Firm* — Christie, Parker & Hale, LLP

(57) ABSTRACT

A packaging/displaying device includes a main blank foldable into a housing that has a bottom panel, two side panels extending upwardly from two opposite sides of the bottom panel, a back panel extending upwardly from the bottom panel and connected between the side panels, and a top panel connected to a top end of the back panel and extending above the bottom panel, said top, bottom and side panels cooperatively defining a housing space for an object, the top panel having a through hole extending through said top panel to retain a top end of an object. The housing is open at its front side to display the object.

19 Claims, 13 Drawing Sheets

PACKAGING/DISPLAYING DEVICE MADE FROM FOLDABLE BLANKS

BACKGROUND OF THE INVENTION

1. Field of the Invention

The invention relates to a packaging device, and more particularly to a packaging device having display functions and made from foldable blanks.

2. Description of the Related Art

Consumer products, such as lighting devices, are usually displayed in retail stores to attract buyers to make their choices. When buyers purchase the products, the products are packed by retailers using packaging boxes so that the products can be carried and transported by the buyers. While various packaging devices with display functions have existed in the prior art, improvements are still needed for convenience in packaging and transportation.

SUMMARY OF THE INVENTION

An object of the present invention is to provide a packaging/displaying device that is made from a foldable blank and that can be packaged and carried conveniently.

According to the present invention, a packaging/displaying device comprises a main blank foldable into a housing. The housing includes a bottom panel, two side panels extending upwardly from two opposite sides of the bottom panel, a back panel extending upwardly from the bottom panel and connected between the side panels, and a top panel connected to a top end of the back panel and extending above the bottom panel. The top, bottom and side panels cooperatively define a housing space for an object. The top panel has a through hole extending through the top panel.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
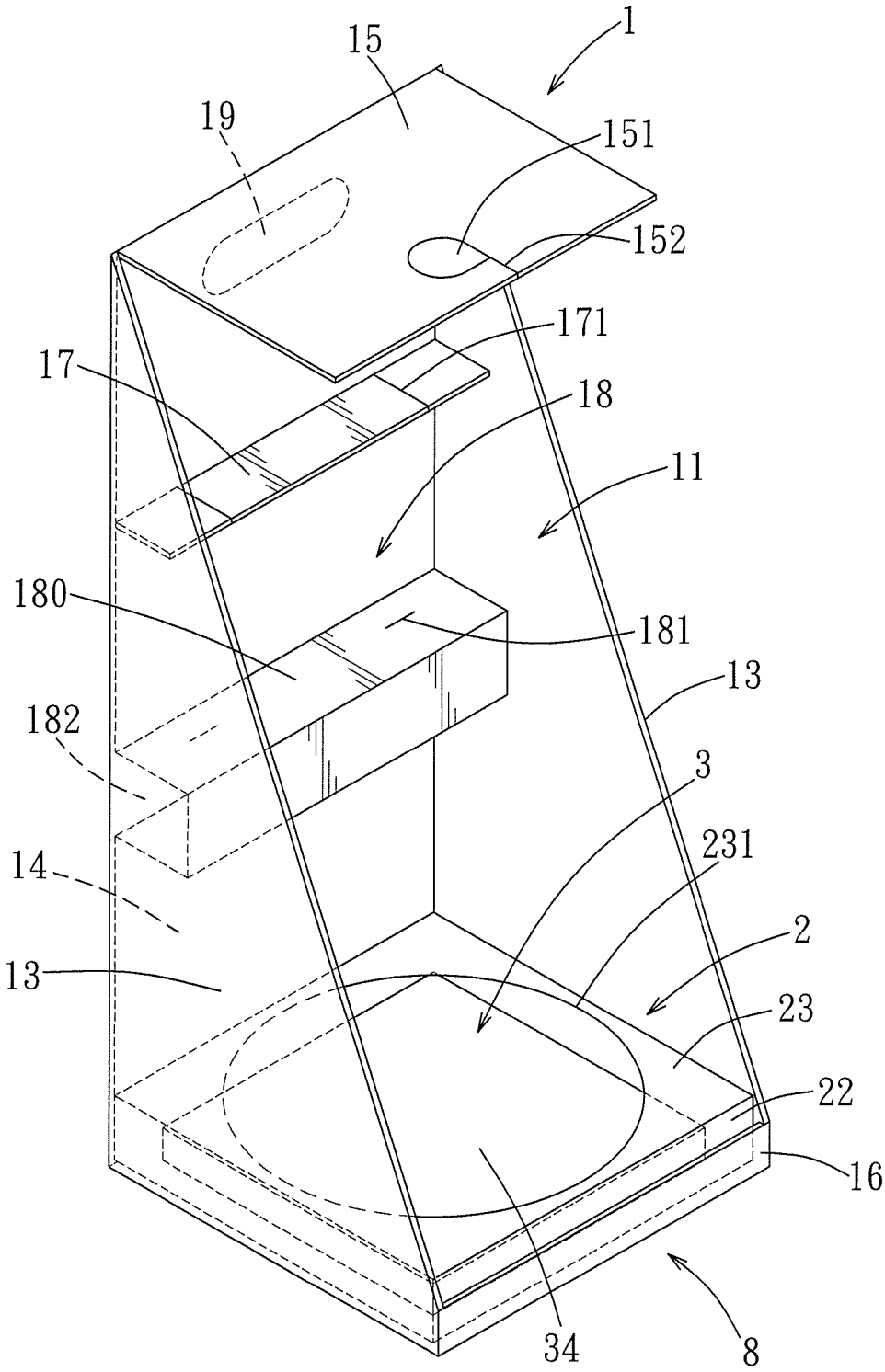
FIG. 1 is a perspective view showing a housing of the packaging/displaying device according to the first preferred embodiment of the present invention.
Figure 2:
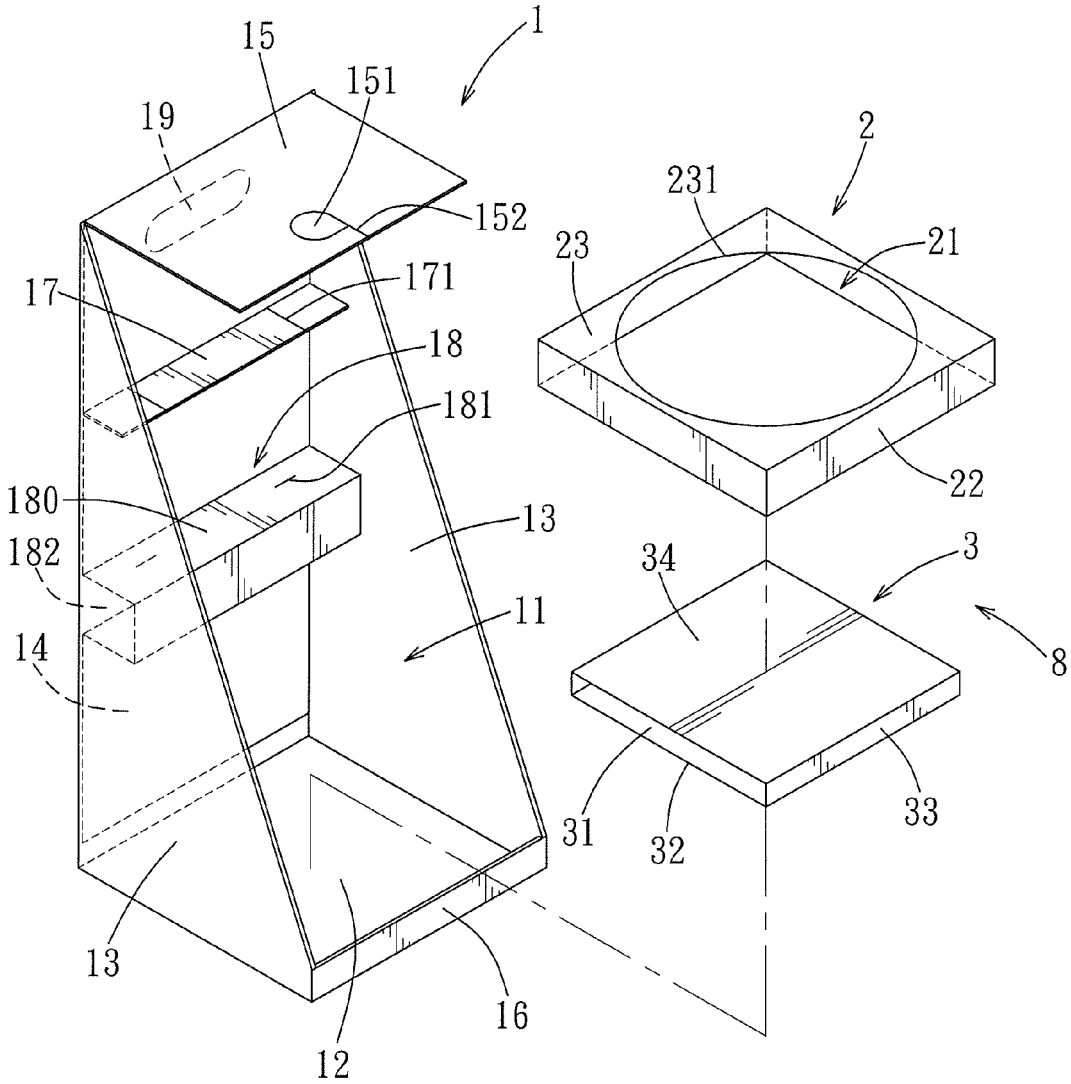
FIG. 2 is an exploded view of the housing of FIG. 1.
Figure 3:
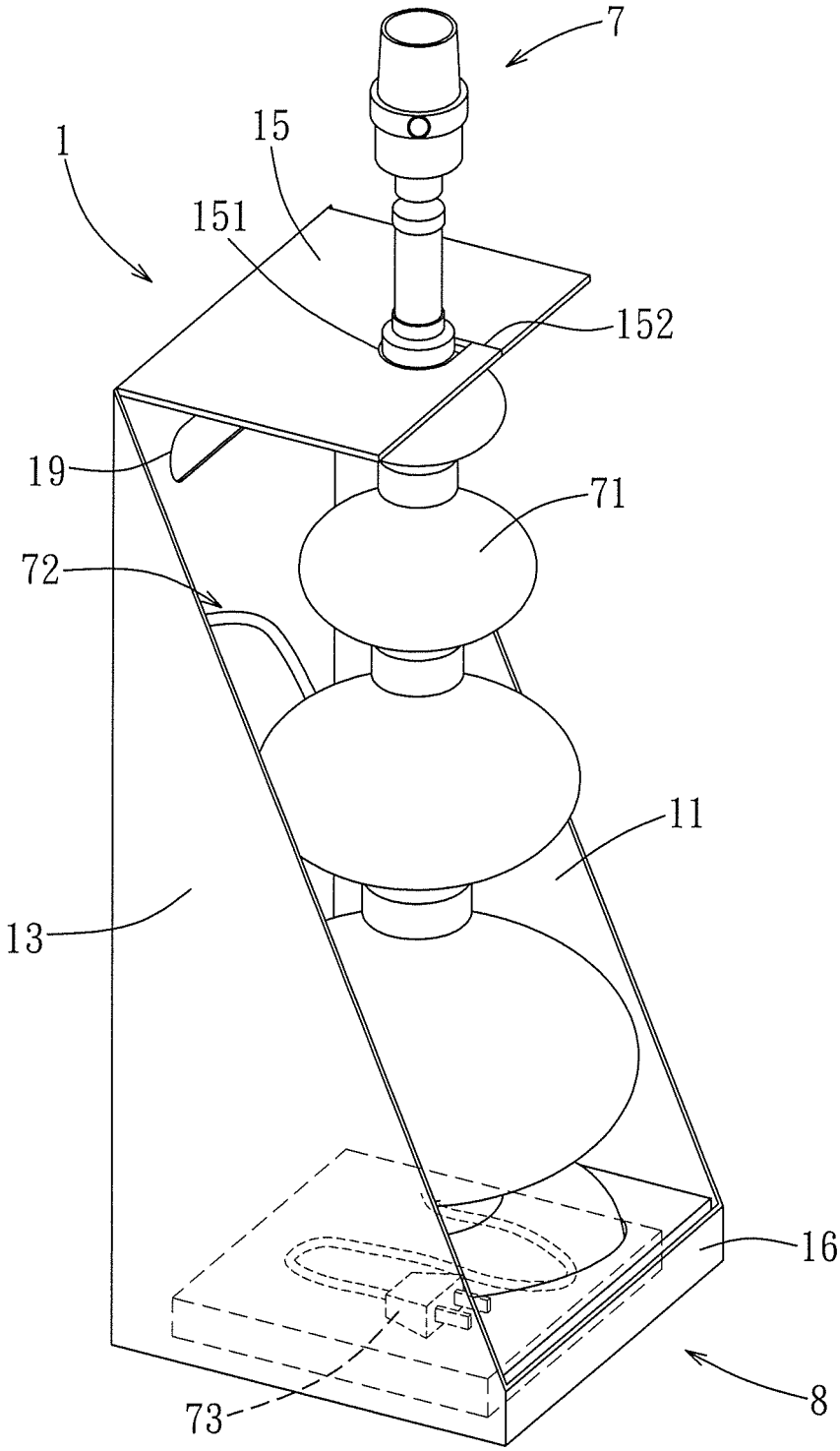
FIG. 3 is a perspective view of the first preferred embodiment in use.

Referring to FIGS. 1-3 and 12, a packaging/displaying device according to a first preferred embodiment of the present invention includes a housing 1, and a seat unit 8. The housing 1 defines a housing space 11 for a lamp 7. As shown in FIG. 3, the lamp 7 has a lamp body 71, a lamp handle 72, and an electrical wire 73.

The housing 1 includes a bottom panel 12, two side panels 13 extending upwardly from two opposite sides of the bottom panel 12, a back panel 14 extending upwardly from the bottom panel 12 and connected to the side panels 13, a front panel 16, a top panel 15 connected to a top end of the back panel 14 and extending above said bottom panel 12, a handling hole 19 disposed in the back panel 14, a first shelf 17 projecting forward and into the housing space 11 from the back panel 14, and a second shelf 18 projecting forward from the back panel 14 below the first shelf 17.

The top panel 12, the bottom panel 12 and the side panels 13 cooperatively define a housing space 11 for housing the lamp 7. The top panel 15 has a top object retaining hole 151 extending through the top panel 15 for extension of a part of the lamp 7, and a gate passage 152 extending from the top object retaining hole 151 to a front edge of the top panel 15. The first and second shelves 17, 18 are used to hold the handle 72 of the lamp 7. The first shelf 17 is a plate that projects from the back panel 14 and has two spaced apart first object retaining holes 171 that extend rearward from a front edge of the first shelf 17 and that also extend through top and bottom sides of the first shelf 17. The first object retaining holes 171 are used for insertion and retention of two straight sections 722 of the lamp handle 72. The second shelf 18 defines a hollow part 182, and has a top shelf plate 180, which is formed with two spaced apart second object retaining holes 181 that are vertically aligned with the first object retaining holes 171, respectively. The second object retaining holes 181 are also used for insertion and retention of the straight sections 722 of the lamp handle 72.

Figure 4:
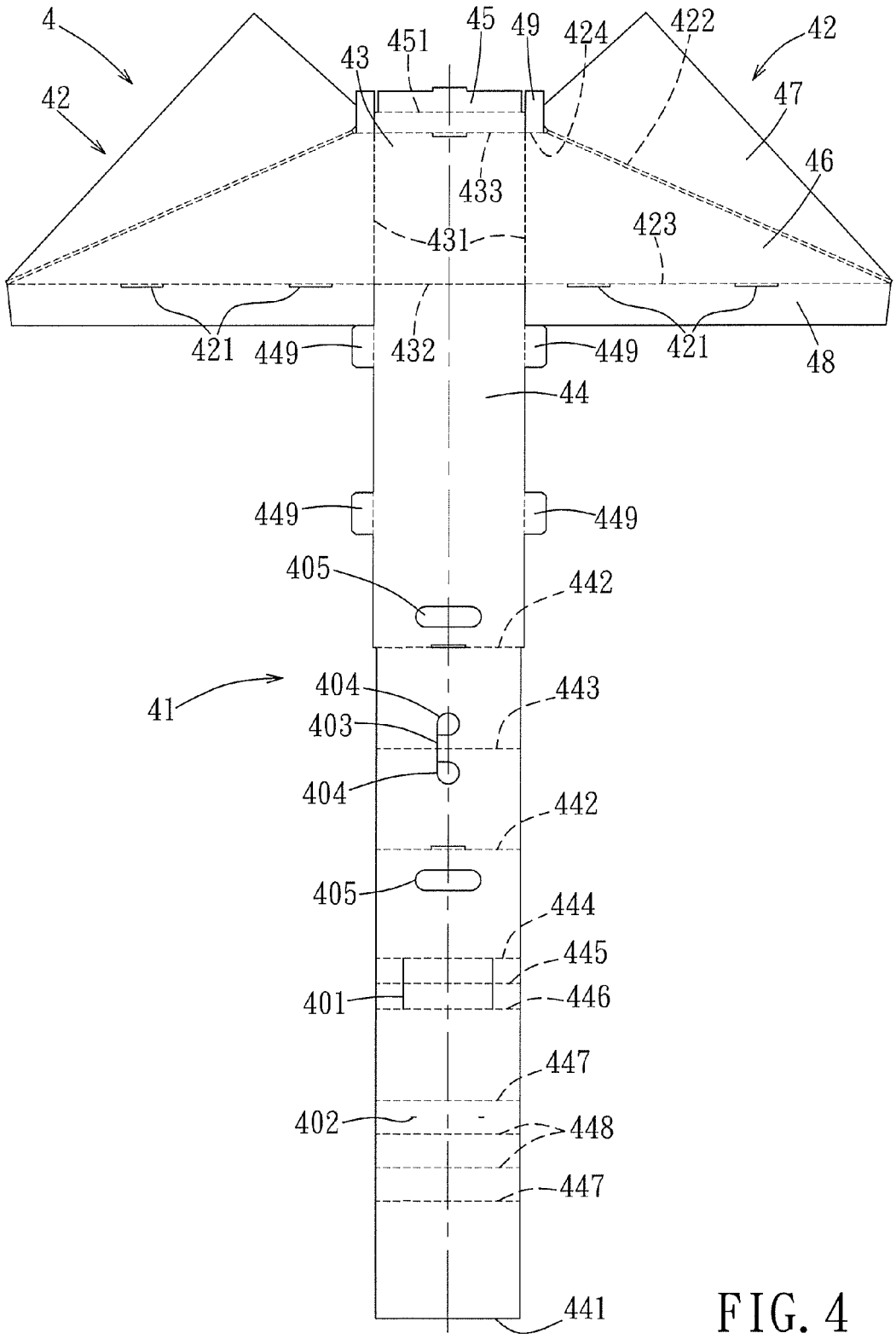
FIG. 4 is an elevation view showing a main blank to form the housing according to the first preferred embodiment.

Referring to FIG. 4, the housing 1 is formed by folding a main blank 4, which includes a longitudinal plate section 41 and two transverse wing sections 42, which forms a T-shaped configuration with the longitudinal plate section 41.

The longitudinal plate section 41 includes a first region 43 between the wing sections 42, and second and fifth regions 44, 45 respectively connected to two opposite ends of the first region 43. Each wing section and the first region 43 have a fold line 431 therebetween. The first and second regions 43, 44 have a fold line 432 therebetween. The first and fifth regions 43, 45 have a fold line 433 therebetween.

Each wing section 42 has a first fold line 422, a twelfth fold line 423, and a thirteenth fold line 424. The first fold line 422 is a dual fold line. Each wing section 42 is partitioned by the first fold line 422 to form a third region 46 connected to the first region 43, and a fourth region 47 connected to the third region 46. The fold line 431 and the first, twelfth and thirteenth fold lines 422, 423, 424 cooperate to form a substantially right-angled triangle for the third region 46. The fourth region 47 also has a right-angled triangular area. Each wing section 42 further has a tenth region 48 connected to the third region 46 through the twelfth fold line 423, and an eleventh region 49 connected to the third region 46 through the thirteenth fold line 424. The third and fourth regions 46, 47 are symmetrical with respect to the first fold line 422, which acts as a hypotenuse line for both the third and fourth regions 46, 47. The tenth region 48 is adjacent to a long one of the catheti of the first region 46. The eleventh region 49 is formed between the fourth region 47 and the fifth region 45.

The second region 44 has an edge 441 distal to the first region 43, two spaced apart second fold lines 442, a third fold line 443 between the second fold lines 442, a fourth fold line 444 between one of the second fold lines 442 and the edge 441, a fifth fold line 445 between the fourth fold line 444 and the edge 441, a sixth fold line 446 between the fourth fold line 444 and the edge 441, two spaced apart seventh fold lines 447 between the sixth fold line 446 and the edge 441, two spaced apart eighth fold lines 448 between the seventh fold lines 447, a first split line 401 that extends across the fifth fold line 445 and connected to the fourth and sixth fold lines 444, 446, two spaced apart second split lines 402 formed between the eighth fold line 448 and one of the seventh fold line 447 proximate to the sixth fold line 446, a plurality of first engaging elements 449 projecting from two sides of the second region 44, two first openings 404 respectively formed in areas between the second and third fold lines 442, 443, a third split line 403 that extends across the third fold line, and two spaced apart second openings 405.

The first openings 404 have equal distances from the third fold line 443. The second openings 405 also have equal distances from the third fold line 443. One of the second openings 405 is disposed between the fold line 432 and one of the second fold lines 442 proximate to the fold line 432. The other second opening 405 is disposed between the other second fold line 442 and the edge 441. Therefore, the second fold lines 442 are disposed between the second openings 405.

The first engaging elements 449 are configured as tabs projecting outward from two opposite side edges of the second region 44. Each wing section 42 further has two second engaging elements 421 disposed along the twelfth fold line 423 to interlock with the respective first engaging elements 449. Each second engaging element 421 is formed as a slit for insertion of the tab of the first engaging element 449.

The fifth region 45 is formed with a fourteenth fold line 451 parallel to the fold line 433.

Figure 5:
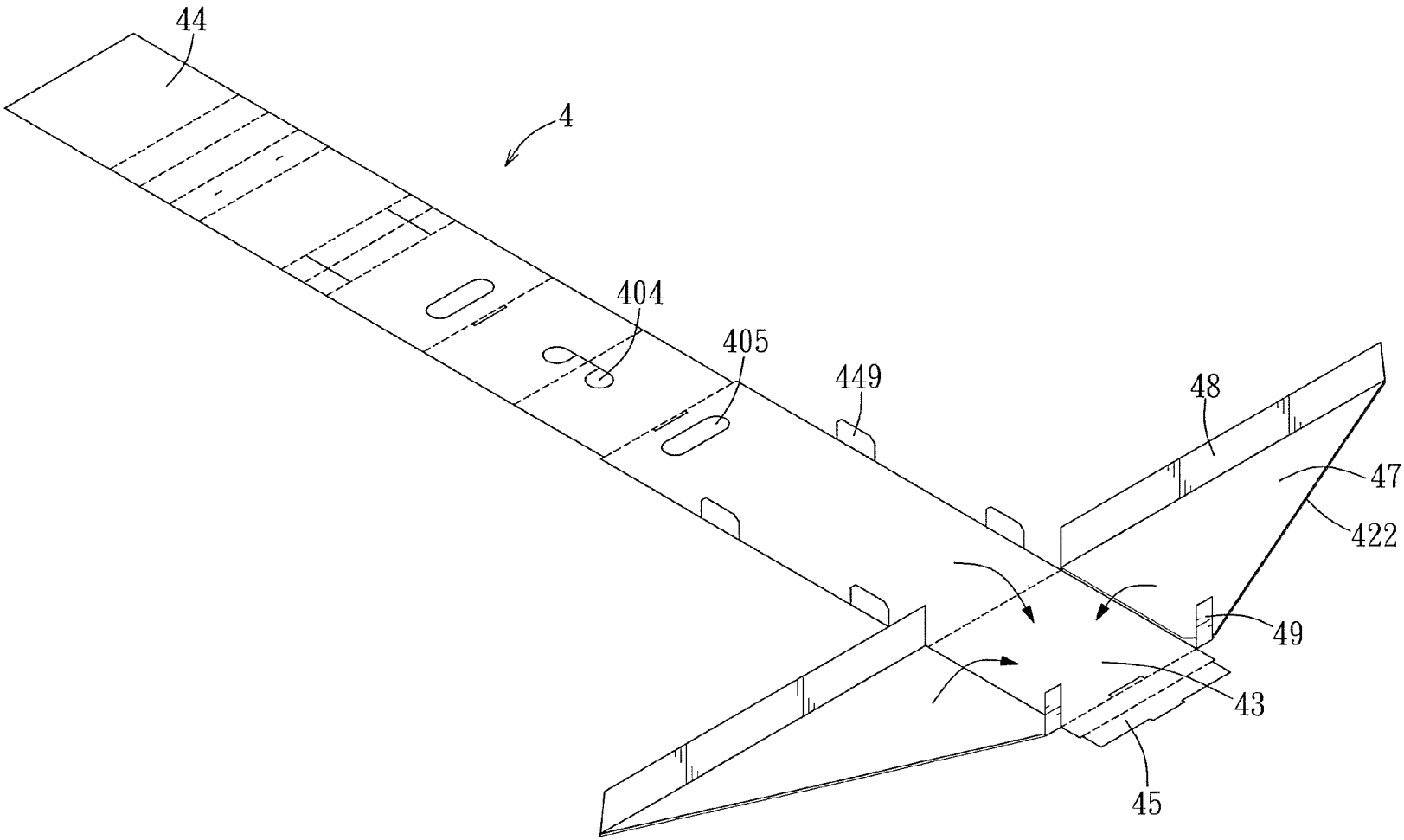
FIGS. 5 to 8 are perspective views illustrating how the main blank of FIG. 4 is folded to form the houisng.

Referring to FIGS. 4 and 5, when the main blank 4 is to be formed into the housing 1, firstly, the fourth regions 47 may be folded over the respective third regions 46 along the respective first fold lines 422 to form triangle parts. Then, the tenth and eleventh regions 48, 49 and the first engaging elements 449 may be folded to project from the plane of the folded third and fourth regions 46, 47.

Figure 6:
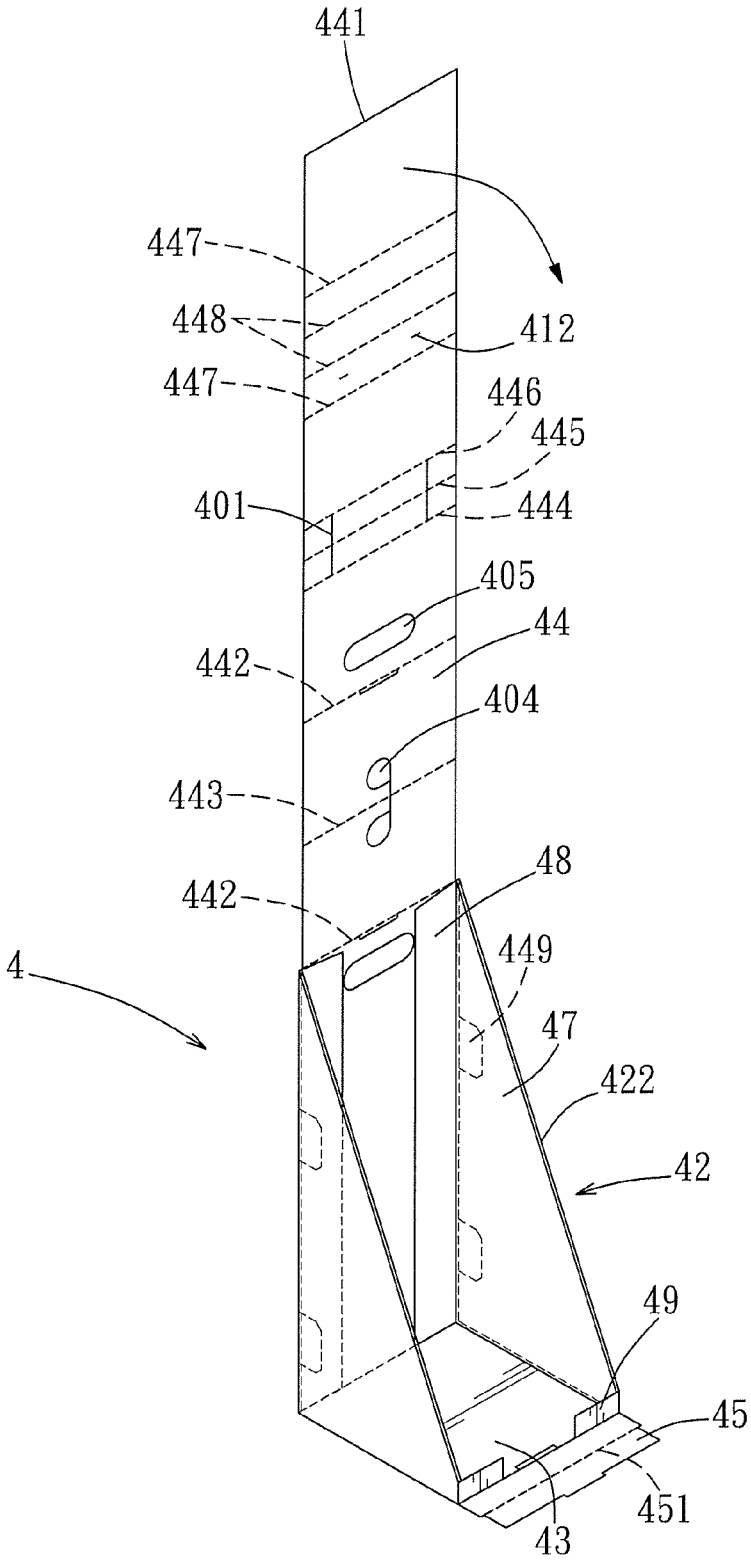

Referring to FIG. 6 in combination with FIGS. 2 and 4, the triangle parts of the wing sections 42 are folded from the main plate section 41 along the respective fold lines 431 to form the side panels 13. Thereafter, the second region 44 is folded along the fold line 432 to extend upward from the first region 43, and the first engaging elements 449 are inserted into the respective second engaging elements 421. As a result, the second region 44 is connected to the triangle parts of the wing sections 42, and the first region 43 is formed into the bottom panel 12.

Figure 7:
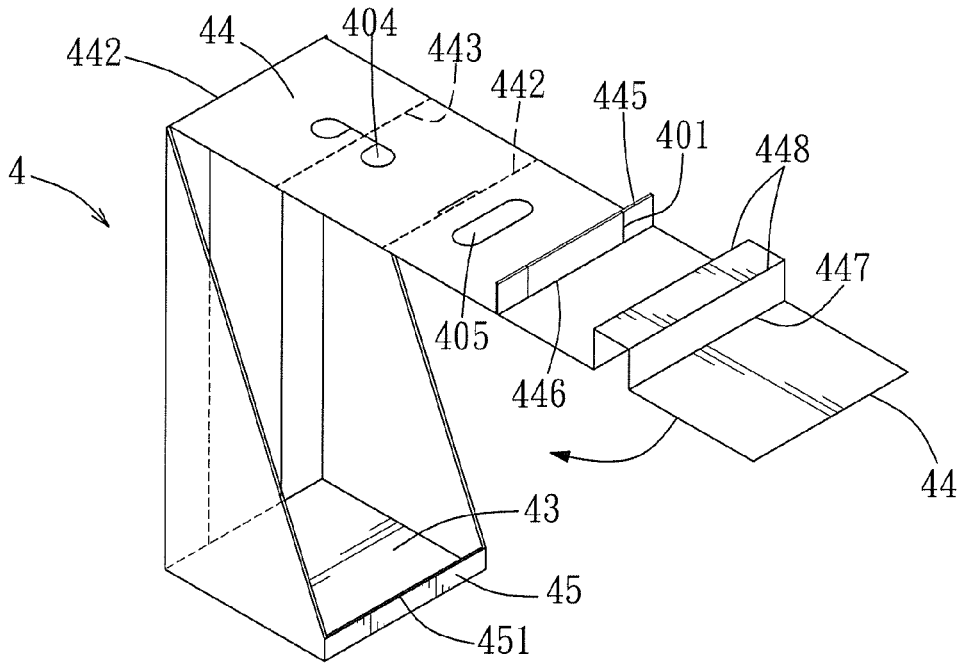

Referring to FIG. 7 in combination with FIGS. 2 and 4, the fifth region 45 is folded in half along the fourteenth fold line 451, and further folded along the fold line 433 to extend upright and to form the front panel 16. When the second region 44 is folded along the fourth, fifth and sixth fold lines 444, 445, 446, the fourth and sixth split lines 444, 446 are aligned with each other, areas between the fourth and fifth split lines 444, 446 are formed into the first shelf 17, and the first split lines are folded to form the first object retaining holes 171, respectively.

When the second region 44 is folded further along the seventh and eighth fold lines 447, 448, areas between the seventh and eighth fold lines 447, 448 are spaced by an area between the eighth fold lines 448 and are formed into the second shelf 18, and the second split lines 402 are formed into the second object retaining holes 181. The top shelf plate 180 of the second shelf 18 is defined by an area between one of the seventh fold line 447 and one of the eighth fold line 448 proximate to the sixth fold line 446.

Figure 8:
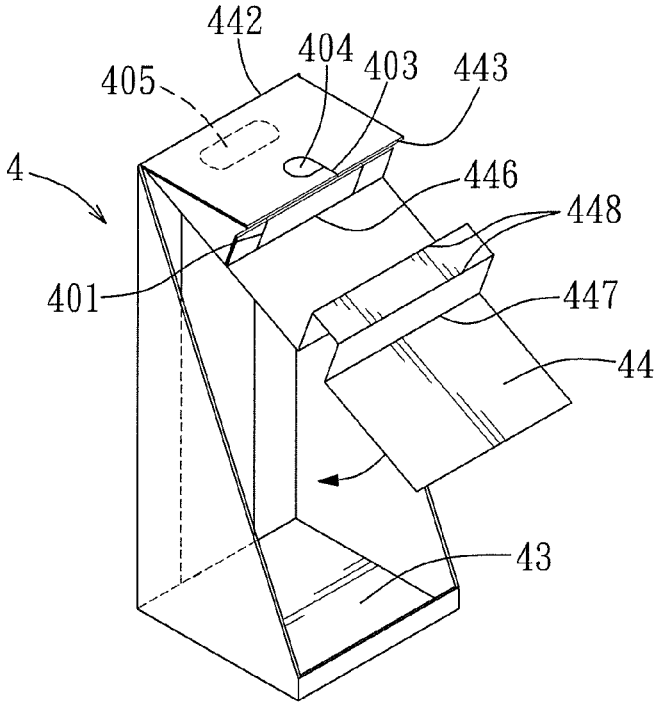

Referring to FIG. 8 in combination with FIGS. 2 and 4, when the second region 44 is folded along the third fold line 443 to form a two-ply structure, the second fold lines 442 are aligned with each other. When the second region 44 is further folded along the second fold lines 442 that are aligned, areas between the second and third fold lines 442, 443 are formed into the top panel 15, areas between the first region 43 and the second fold lines 442 are formed into the back panel 14, the first openings 404 are aligned and formed into the top object retaining hole 151. The second openings 405 are aligned and formed into the handling hole 19. The third split line 403 is folded in half to define the gate passage 152.

Referring back to FIGS. 2 and 3, the seat unit 8 is disposed on the bottom panel 12, and includes first and second seats 2 and 3. The first seat 2 has a first hollow space 21 defined by an upper wall 23 and multiple sidewalls 22 that extend laterally downward from the upper wall 23. A seat hole 231 is formed in the upper wall 23 and communicated with the first hollow space 21. A bottom part of the lamp body 71 may be inserted into and retained by the seat hole 231.

Figure 9:
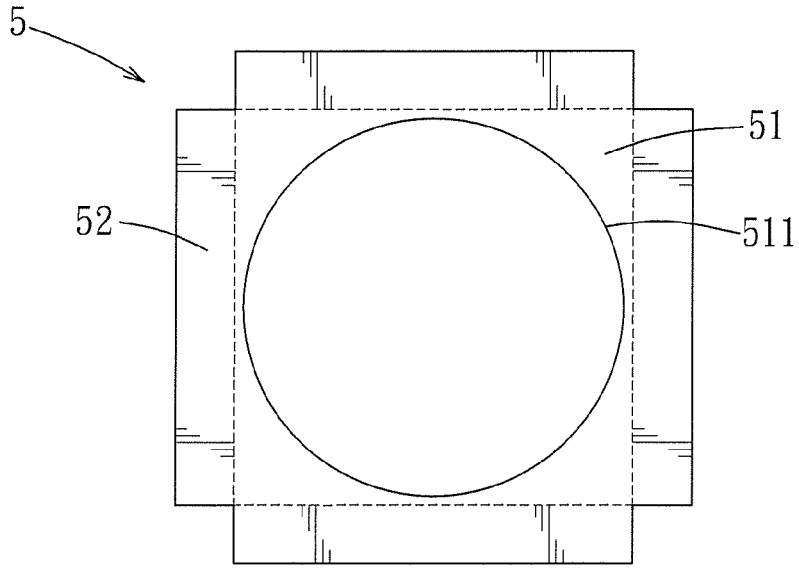
FIG. 9 is an elevation view showing a blank to form a first seat for the housing of FIG. 4.

Referring to FIG. 9 in combination with FIG. 2, the first seat 2 is made by folding a blank 5 that includes a central region 51 formed with an opening 511, and four flange plates 52 extending from four sides of the central region 51. When the blank 5 is folded, the central region 51 becomes the upper wall 23, the flange plates 52 project from the central region 51 to form the sidewalls 22, and the opening 511 forms the seat hole 231.

Figure 10:
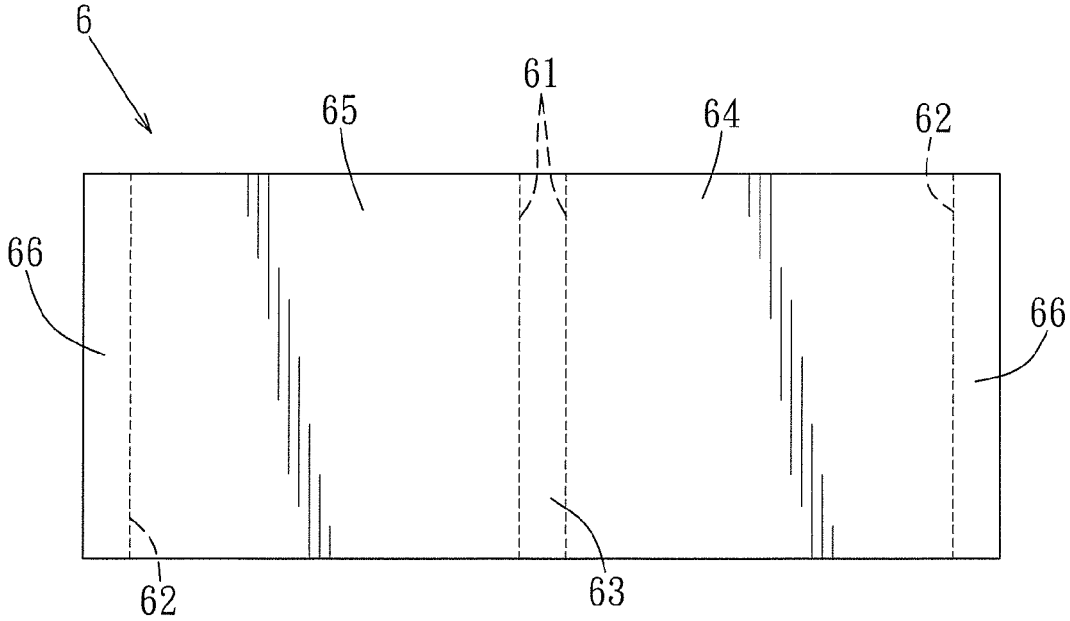
FIG. 10 is an elevation view showing a blank to form a second seat for the housing of FIG. 4.
Figure 11:
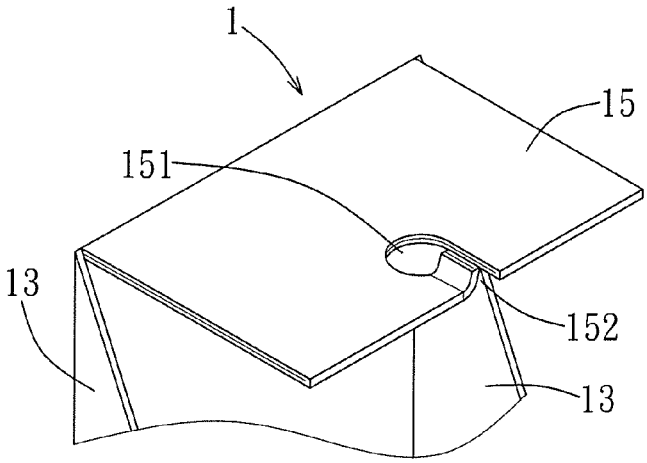
FIG. 11 is a fragmentary view showing a top panel of the housing.
Figure 12:
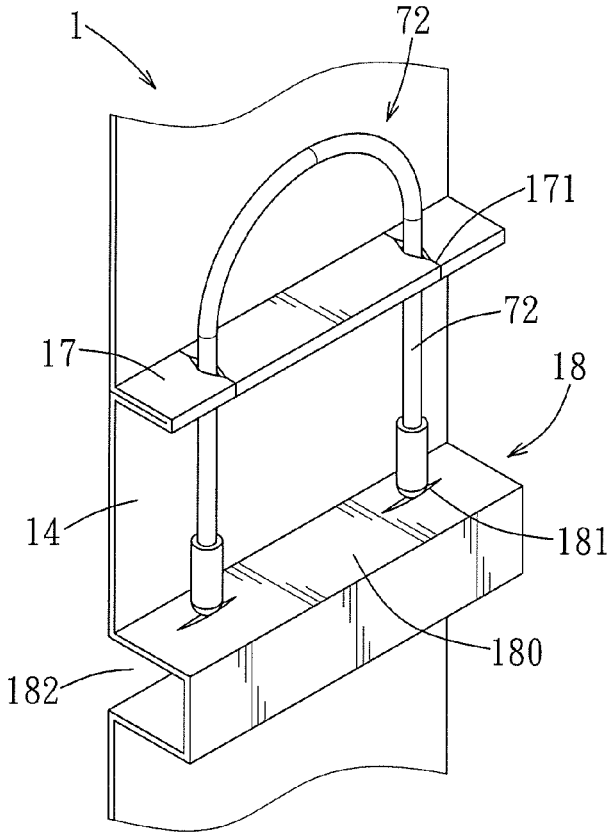
FIG. 12 is a fragmentary view showing a back panel of the housing.

Referring to FIG. 10 in combination with FIG. 2, the second seat 3 has a second hollow space 31 to receive an electric wire 73 of the lamp 7. The second seat 3 is disposed in the first hollow space 21 below the upper wall 23 of the first seat 2. The second seat 3 has a bottom wall 32, two sidewalls 33 extending upward from the bottom wall 32, and a top wall 34. The second seat is formed by folding a blank 6, which has two ninth fold lines 61, two tenth fold lines 62, a sixth region 64, a seventh region 65, two eighth regions 66, and a ninth region 63.

Referring to FIGS. 2, 3, 11 and 12, when the packaging/displaying device is in use, the first and the second seats 2, 3 are disposed on the bottom panel 12. The electrical wire 73 is placed within the second seat 3. The handle 72 is inserted into the first and second object retaining holes 171, 181 and is therefore retained by the shelves 17 and 18. The bottom part of the lamp body 71 is seated in the seat hole 231 of the first seat 2 above the top wall 34 of the second seat 3. The top part of the lamp body 71 is inserted into the top object retaining hole 151 of the top panel 15 through the gate passage 152. The user may carry the displaying/packaging device with the lamp 7 by holding the back panel 14 at the handling hole 19.

Figure 13:
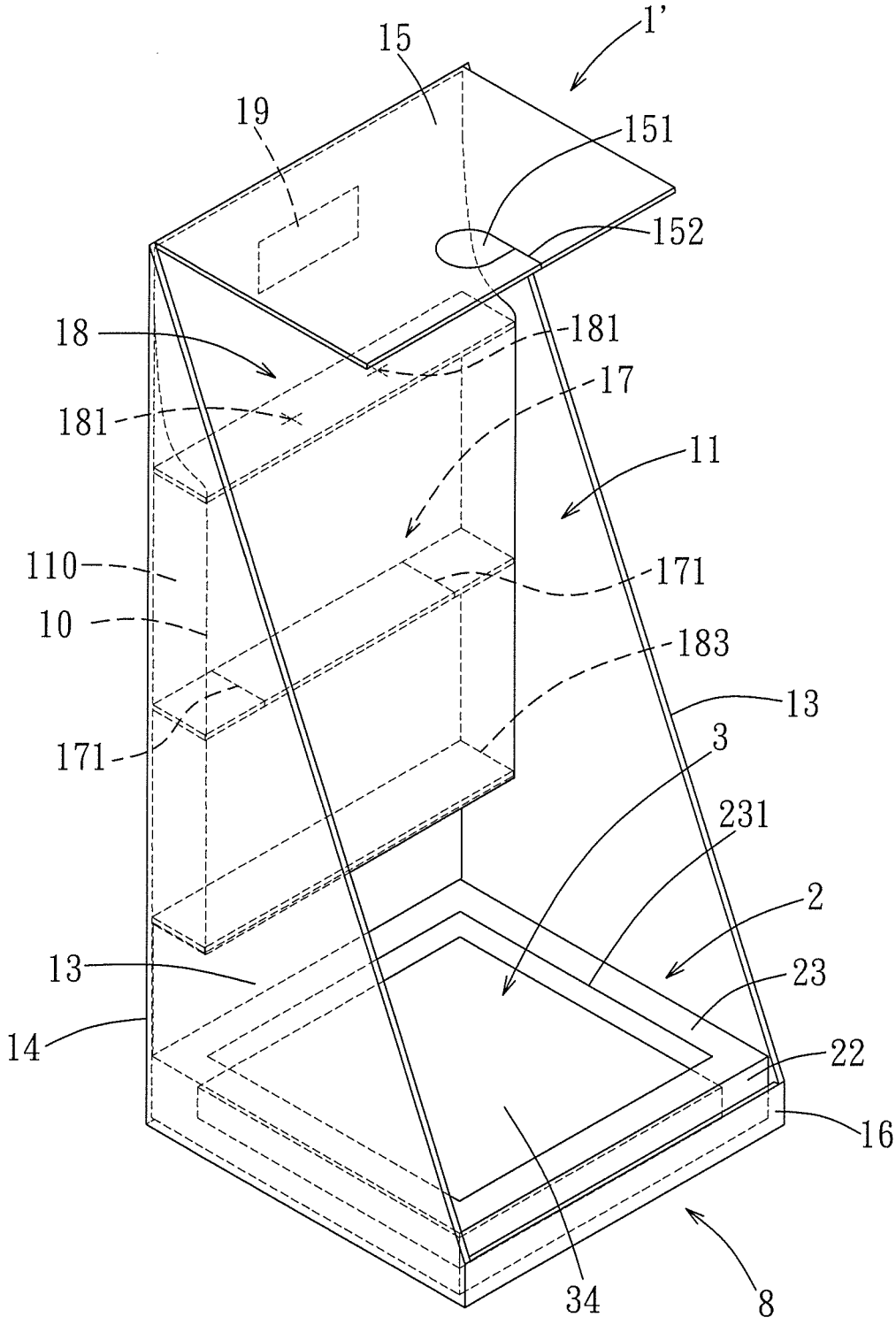
FIG. 13 is a perspective view showing a housing of the packaging/displaying device according to the second preferred embodiment of the present invention.
Figure 14:
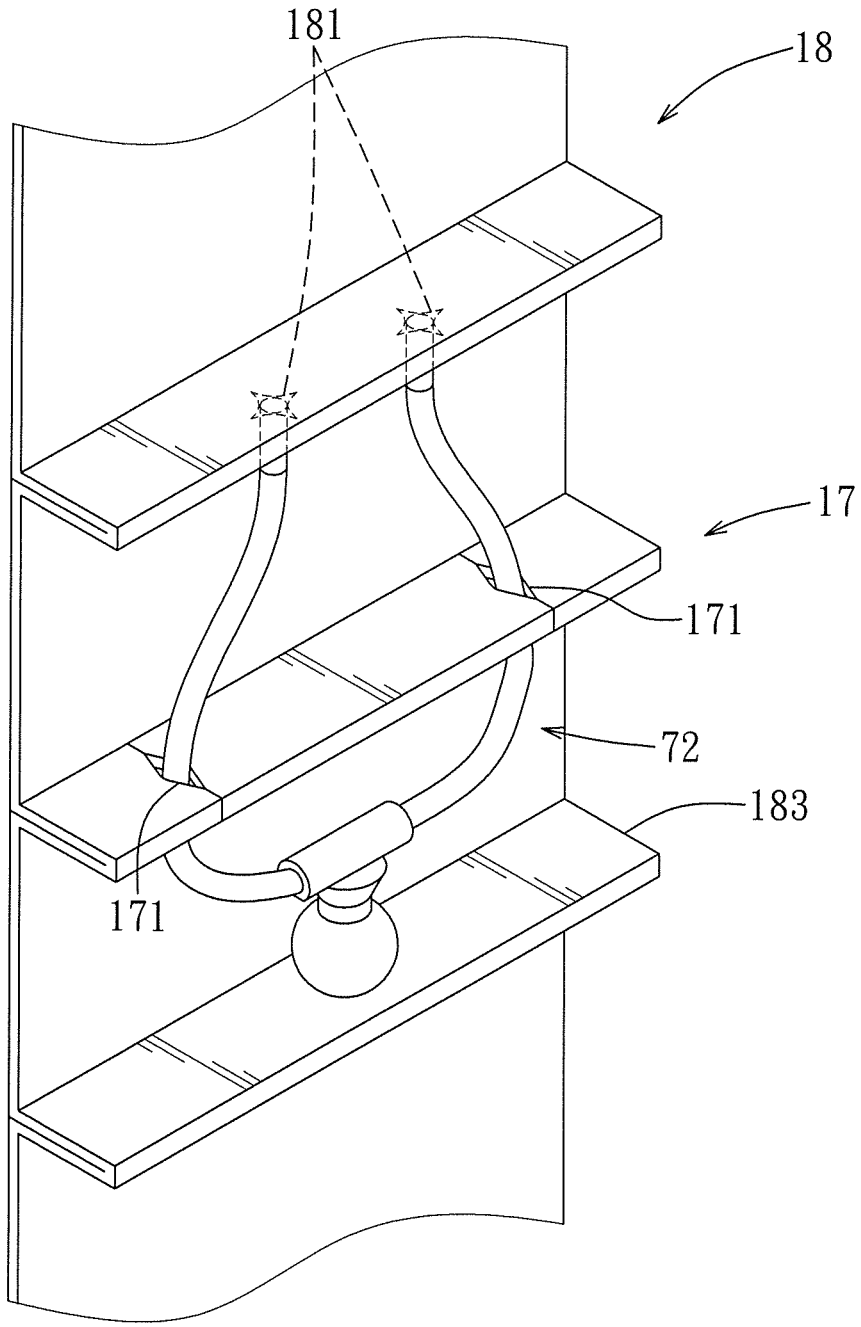
FIG. 14 is a fragmentary view showing a back panel of the housing of FIG. 13.

Referring to FIGS. 13 and 14, the housing 1' according to a second preferred embodiment of the pre sent invention is substantially similar to that of the first preferred embodiment. However, to hold the lamp handle 72, the second embodiment additionally has a third shelf 183, and the second shelf 18 is disposed above the first shelf 17.

Figure 15:
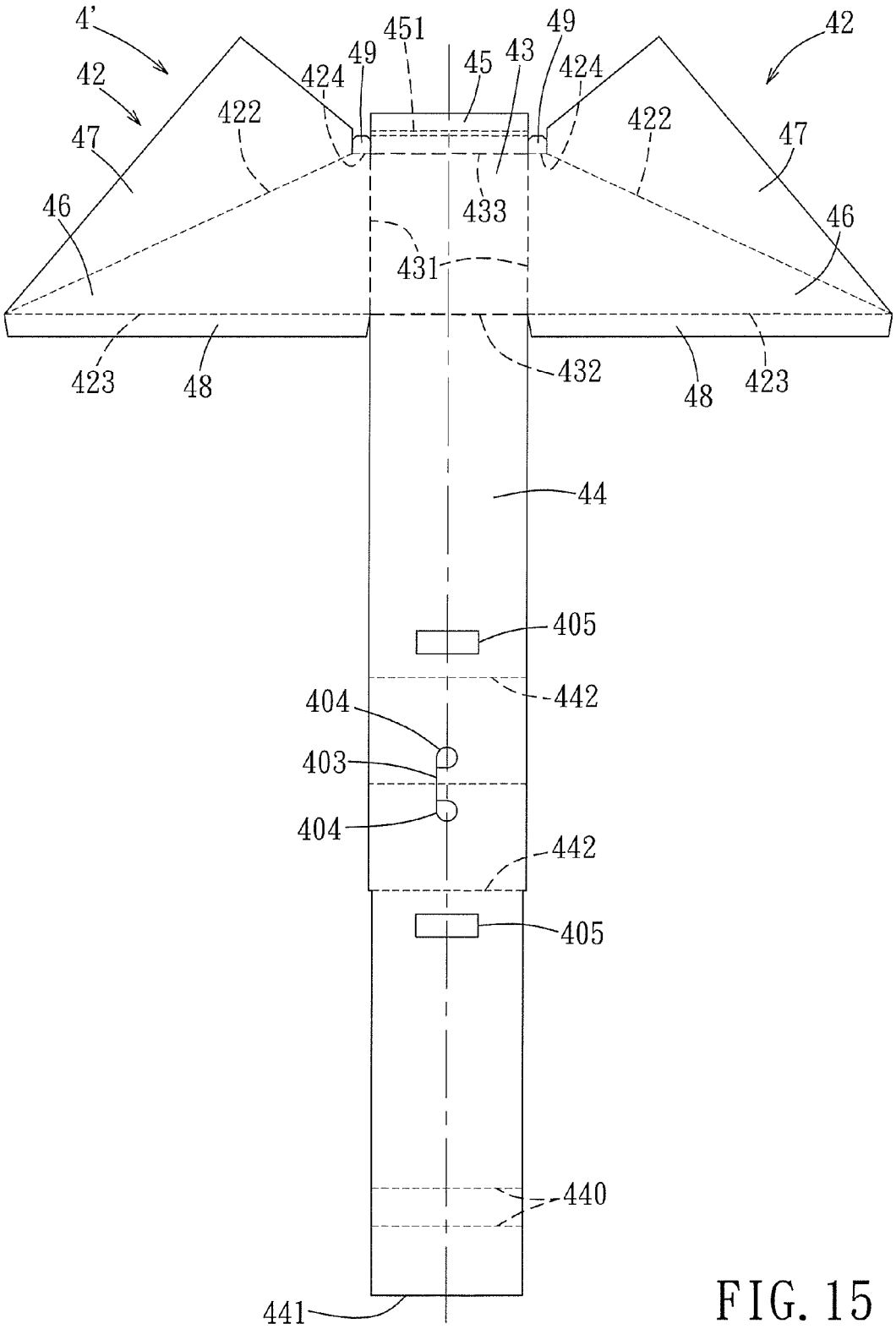
FIG. 15 is an elevation view showing a main blank to form the housing of FIG. 13.
Figure 16:
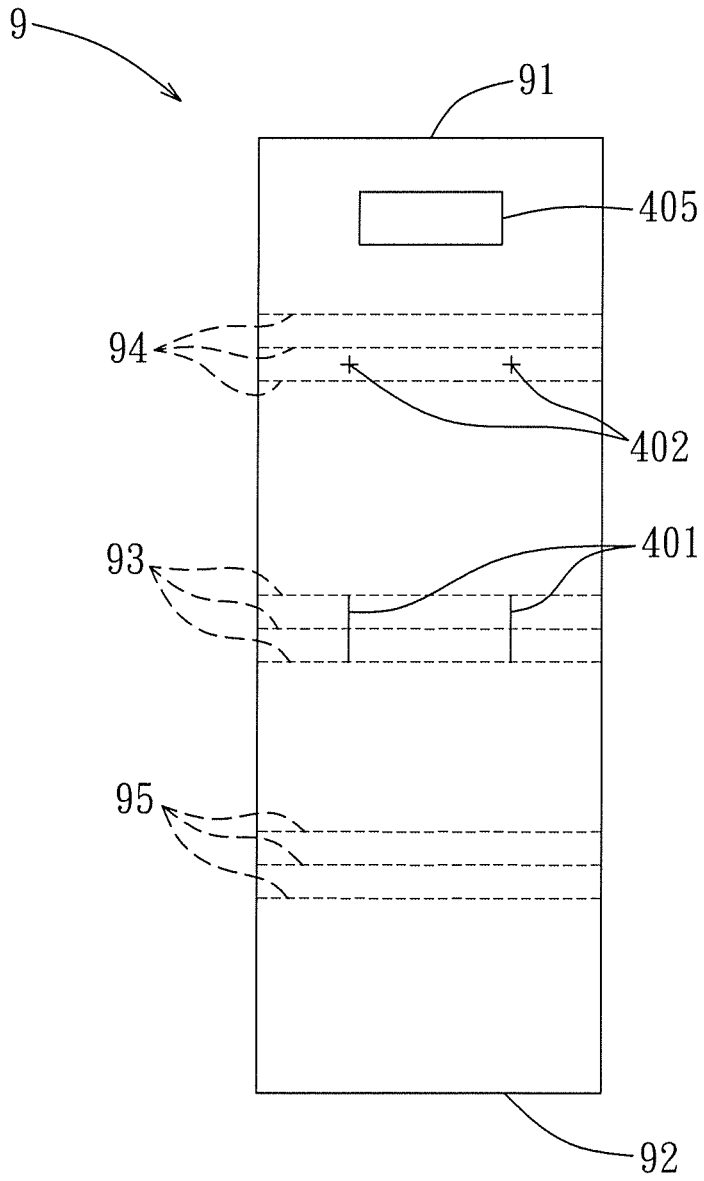
FIG. 16 is an elevation view showing an auxiliary blank to form shelves on the housing of FIG. 13.

Referring to FIGS. 15 and 16, the housing 1' is formed from a main blank 4' and a longitudinal auxiliary blank 9 attached to the main blank 4'. The longitudinal auxiliary blank 9 includes two longitudinally opposed first and second edges 91, 92, three spaced apart auxiliary blank first fold lines 93 between the first and second edges 91, 92, three spaced apart auxiliary blank second fold lines 94 between the first edge and the group of the auxiliary blank first fold lines 93, three spaced apart auxiliary blank third fold lines 95 between the second edge 92 and the group of the auxiliary blank third fold lines 95, two auxiliary blank first split lines 401 each extending across a mid one of the auxiliary blank first fold lines 93 and connected to the remaining auxiliary blank first fold lines 93, and two auxiliary blank second split lines 402 disposed between two auxiliary blank second fold lines 95.

When the auxiliary blank 9 is folded along the auxiliary blank first, second and third fold lines 93, 94, 95, areas between the auxiliary blank first fold lines 93 are superimposed on one another and formed into the first shelf 17, the auxiliary blank first split lines 401 are folded to form the first object retaining holes 171, respectively, areas between the auxiliary blank second fold lines 94 are superimposed on one another and formed into the second shelf 18, the auxiliary blank second split lines 402 are folded to form the second object retaining holes 181, respectively, and areas between the auxiliary blank third fold lines 95 are superimposed on one another and formed into the third shelf 183.

The housing 1' further has a partition 10 disposed inside the housing space 11 to confine a receiving space 110 to receive and shield the first, second and third shelves 17, 18, 183. The partition 10 is formed from the second region 44 of the main blank 4. In particular, the second region 44 has two spaced apart eighteenth fold lines 440 between the edge 441 and the group of the second fold lines 442. The second region 44 is folded along the aligned second fold lines 442, and the eighteenth fold lines 440 so that an area between the edge 441 and the group of the second fold lines 442 is formed into the partition 10. The receiving space 110 is formed behind the area between the edge 441 and the group of the second fold lines 442. The auxiliary blank 9 is disposed in the receiving space 110, and the first edge 91 of the auxiliary blank 9 is glued to the second region 44 of the main blank 4' along the second fold lines 442.

The second embodiment is not provided with the first and second engaging elements 421, 449. The tenth regions 48 are glued to the second region 44 so that the side panels 13 of the housing 1' are connected to back panel 14. The seat hole 231 in the second embodiment is rectangular.

As described hereinbefore, the packaging/displaying device of the invention can be used to display the lamp 7 because the housing 1 or 1' is opened at its front side to display the lamp 7. When a buyer buys the lamp 7, the lamp 7 together with the housing 1 or 1' may be carried easily by inserting his or her hand into the handling hole 19 to hold the housing 1 of 1'. The lamp 7 need not be re-packaged using another packaging device. According to the second preferred embodiment, the packaging/displaying device may be made without using adhesive to facilitate assembly of the packaging/displaying device.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A packaging and displaying device for an object, comprising:

a main blank foldable into a housing;

said housing including a bottom panel, two side panels extending upwardly from two opposite sides of said bottom panel, a back panel extending upwardly from said bottom panel and connected between said side panels, and a top panel connected to a top end of said back panel and extending above said bottom panel, said top, bottom and side panels cooperatively defining a housing space for an object, said top panel having a through hole extending through said top panel to receive and retain a top end of the object, said housing being open at a front side to display the object, wherein said main blank has a longitudinal main plate section, and two wing sections projecting transversely from two opposite sides of said main plate section, said main plate section and said wing sections forming a substantially T-shaped configuration, said wing sections being folded from said main plate section to form said side panels, respectively, said main plate section having a first region between said wing sections, and a second region connected to said first region, said first region forming said bottom panel, said second region being folded from said first region and forming said back and top panels.

2. The packaging and displaying device of claim 1, wherein each of said wing section is divided by a first fold line to form a third region connected to said first region, and a fourth region connected to said third region and opposite to said first region, said fourth region of each of said wing section being folded over said third region along said first fold line to form one of said side panels, said third region being folded from said first region, each of said side panels being triangular.

3. The packaging and displaying device of claim 1, wherein said second region has two spaced apart second fold lines, both of which are distal to said first region, and a third fold line between said second fold lines, said second region being folded along said third fold line to form a two-ply structure, said second fold lines being aligned with each other in said two-ply structure, said two-ply structure being folded along said second fold lines to form said top and back panels, areas between said second and third fold lines forming said top panel, areas between said second fold lines and said first region forming said back panel.

4. The packaging and displaying device of claim 1, wherein said second region has a plurality of first engaging elements, each of said wing sections having a plurality of second engaging elements, said side panels being connected to said back panel through an interlocking of said first engaging elements with respective said second engaging elements.

5. The packaging and displaying device of claim 4, wherein each of said first engaging elements is configured as a tab projecting outward from an edge of said second region, each of said second engaging elements is configured as a slit for insertion of said tab, said tab being folded toward said side panel and inserted into said slit to connect said back panel to one of said side panels.

6. The packaging and displaying device of claim 3, wherein said housing further includes a first shelf projecting forward and into said housing space from said back panel.

7. The packaging and displaying device of claim 6, wherein said first shelf has two spaced apart first object retaining holes.

8. The packaging and displaying device of claim 6, wherein said housing further includes a second shelf that projects forward from said back panel below said first shelf and that has a hollow structure, and two spaced apart second object retaining holes, which are vertically aligned with said first object retaining holes, respectively.

9. The packaging and displaying device of claim 3, wherein said second region has two first openings respectively formed in areas between said second and third fold lines and having equal distances from said third fold line, said first openings being aligned with each other to form a top object retaining hole in said top panel.

10. The packaging and displaying device of claim 9, wherein said top panel has a gate passage that extends from a front edge of said top panel to said top object retaining hole, said second region further having a first split line that extends across said fifth fold line and that forms said gate passage when said second region is formed into said two-ply structure.

11. The packaging and displaying device of claim 3, wherein said housing further includes a handling hole formed in said back panel, said second region further having two spaced apart second openings, said second fold lines being disposed between said second openings, said second openings being formed into said handling hole when said second region is folded to form said two ply structure.

12. The packaging and displaying device of claim 1, further comprising a seat unit that is disposed on said bottom panel and that includes a first seat that has a first hollow space, an upper wall formed above said first hollow space, and a seat hole formed in said upper wall and communicated with said first hollow space.

13. The packaging and displaying device of claim 12, wherein said seat unit further includes a second seat that has a second hollow space and that is disposed in said first hollow space.

14. The packaging and displaying device of claim 8, wherein said second region further has an edge distal to said first region and substantially parallel to said second fold lines, a fourth fold line between said second fold line and said edge, a fifth fold line between said fourth fold line and said edge, a sixth fold line between said fourth fold line and said edge, two spaced apart second split lines each having two opposite ends connected respectively to said fourth and sixth split lines, wherein, when said second region is folded along said fourth, fifth and sixth fold lines, said fourth and sixth split lines are aligned with each other, areas between said fourth and fifth split lines form said first shelf, and said second split lines form said first object retaining holes.

15. The packaging and displaying device of claim 14, wherein said second region further has two spaced apart seventh fold lines between said sixth fold line and said edge, two spaced apart eighth fold lines between said seven fold lines, two spaced apart third split lines disposed between one of said seventh fold lines and one of said eight fold lines, wherein, when said second region is folded further along said seventh and eighth fold lines, areas between said seventh and eighth fold lines are spaced by and cooperate with an area between said eighth fold lines to form said second shelf, said third split lines forming said second object retaining holes.

16. The packaging/displaying device of claim 3, wherein said housing further includes first, second and third shelves projecting forward from said back panel, said second and third shelves being respectively disposed above and below said first shelf, said first shelf having two first object retaining holes, said second shelf having two second object retaining holes aligned with said first object retaining holes, respectively.

17. The packaging/displaying device of claim 16, further comprising a longitudinal auxiliary blank attached to said back panel and folded to form said first, second and third shelves, said auxiliary blank including two longitudinally opposed first and second edges, three spaced apart auxiliary blank first fold lines between said first and second edges of said auxiliary blank, two auxiliary blank first split lines each extending across a mid one of said auxiliary blank first fold lines, wherein, when said auxiliary blank is folded along said auxiliary blank first fold lines, areas between said auxiliary blank first fold lines are superimposed on one another and form said first shelf, and said auxiliary blank first split lines form said first object retaining holes, respectively.

18. The packaging/displaying device of claim 17, wherein said auxiliary blank further includes three spaced apart auxiliary blank third fold lines between said first edge and one of said auxiliary blank first fold lines, and two auxiliary blank second split lines extending across a mid one of said auxiliary blank third fold lines, wherein said second shelf is formed when said auxiliary blank is folded along said auxiliary blank third fold lines, said auxiliary blank second split lines forming said second object retaining holes.

19. The packaging/displaying device of claim 16, wherein said housing further has a partition disposed inside said housing space to cover said first, second and third shelves.

* * * * *